United States Patent [19]

Wenzel

[11] Patent Number: 4,612,135

[45] Date of Patent: Sep. 16, 1986

[54] ALL-PURPOSE SANITARY CLEANING COMPOSITION

[75] Inventor: George Wenzel, New Milford, Conn.

[73] Assignee: Sanitary Products Corp., West Haven, Conn.

[21] Appl. No.: 765,578

[22] Filed: Aug. 14, 1985

Related U.S. Application Data

[63] Continuation of Ser. No. 520,626, Aug. 5, 1983, abandoned.

[51] Int. Cl.[4] ..... C11D 3/43; C11D 3/48

[52] U.S. Cl. ..... 252/106; 252/100; 252/142; 252/143; 252/153; 252/547; 252/DIG. 14

[58] Field of Search ..... 134/41; 252/100, 106, 252/142, 143, 147, 136, 148, 547, 153, DIG. 14

[56] References Cited

U.S. PATENT DOCUMENTS

| | | | |
|---|---|---|---|
| 2,629,696 | 2/1953 | Dodd et al. | 252/136 |
| 2,672,449 | 3/1954 | Snell et al. | 252/100 |
| 3,223,643 | 12/1965 | Law | 252/106 |
| 3,733,277 | 5/1973 | Wooden et al. | 252/106 |
| 3,793,221 | 2/1974 | Otrhalek et al. | 252/136 |
| 4,013,579 | 3/1977 | Nakasone et al. | 252/143 |
| 4,020,016 | 4/1977 | Sokol | 252/546 |

FOREIGN PATENT DOCUMENTS 1215741 4/1960 France .

*Primary Examiner*—Prince E. Willis

*Attorney, Agent, or Firm*—Larson and Taylor

[57] ABSTRACT

An all-purpose sanitary cleaning composition has been developed which eliminates the need for the numerous individual cleaners presently used in the maintenance of restrooms. The cleaning composition is a mixture of water, phosphoric acid, oxalic acid, an alkylene glycol monoalkyl ether solvent, a non-ionic surfactant, a cationic surfactant comprising fluorinated alkyl quaternary ammonium halide, and an olfactory agent, in defined proportions.

5 Claims, No Drawings

ALL-PURPOSE SANITARY CLEANING COMPOSITION

This application is a continuation of application Ser. No. 520,626 filed Aug. 5, 1983, now abandoned.

BACKGROUND OF THE INVENTION

This invention relates to all-purpose cleaning compositions. More particularly the invention is directed to cleaning compositions which can be singularly used in the cleaning and maintenance of restrooms.

To professionally clean and maintain lavatories, particularly in large commercial buildings, it has heretofore been necessary to use a number of cleaner products such as toilet bowl cleaners, deodorizers, abrasive cleaners, bright-work polishes and cleaners, floor soap, all-purpose detergents and cleaners, tile and grout cleaners and abrasive pads. Attempts have been made in the past to replace these products with a single product which can be used effectively in each of the cleaning operations normally accomplished by different individual products. Unfortunately, all such attempts have failed in one way or another. For example, prior art compositions formulated as single product cleaners have been found to suffer from one or more of the following drawbacks:

(1) fail to perform as effectively in one or more of the different cleaning applications as the normally used individual product.

(2) exhibit dilution handling and application difficulties.

(3) are not environmentally acceptable, e.g. constituting a hazard to the surfaces treated and/or persons who come in contact with the cleaner.

(4) possess an intolerable odor.

(5) exhibit an inability to adapt to other cleaning environments.

(6) are expensive.

(7) leave unsightly films or streaks upon drying necessitating an additional step of rinsing, etc.

The prior art as exemplified by U.S. Pat. Nos. 3,793,221, 3,832,234 and 4,181,622 and the Union Carbide publication entitled, "Emulsions and Detergents", Union Carbide Company, New York (1961) is filled with descriptions of acid cleaning compositions including inorganic acids such as oxalic and citric acids such as phosphoric acid, hydrochloric acid and mixtures thereof. To date none of these cleaning compositions has proved to be an acceptable single, multi-purpose cleaning compositions for one or more of the reasons noted above.

OBJECTS OF THE INVENTION

It is an object of the invention, therefore, to provide a cleaner composition free of the aforementioned drawbacks. Specifically, it is an object of the invention to provide a single cleaner composition capable of cleaning everything found in a restroom; in short a cleaner composition which can replace a minimum of seven or more other products normally used for lavatory maintenance.

Another object of the invention is to provide a cleaner composition which is environmentally-acceptable and is not a hazard either to the surfaces on which it is used or the people who use it.

Yet another object of the invention is to provide an inexpensive cleaner composition which provides as efficient, if not more efficient, cleaning action as is provided by the numerous individual cleaners presently used in the maintenance of restrooms.

A further object is to provide a cleaner composition which has an extraordinarily pleasant odor.

Another object of the invention is to provide a cleaner composition which is easily transportable and adaptable to a multitude of uses.

These and other objects will be apparent from the description of the invention which follows.

SUMMARY OF THE INVENTION

These and other objects of the invenion are obtained by a liquid concentrate comprising about 0.12 to 20% by weight phosphoric acid, about 0.04 to 9% by weight oxalic acid, about 0.1 to 17% by weight of a non-ionic surfactant, about 0.03 to 0.3% by weight of a cationic surfactant comprising a fluorinated alkyl quaternary ammonium halide, about 0.14 to 40% by weight of an alkylene glycol monoalkyl ether solvent and about 0.006 to 1.5% by weight of an olefactory agent, with the balance water, and with the proviso that the phosphoric acid be present in an amount in excess of the oxalic acid.

The principal components of the concentrate of the invention are the two acids, i.e. phosphoric acid and oxalic acid, both of which are essential to the composition of the invention. Omission of either of the acids fails to provide a cleaner composition which is capable of removing the various stains or otherwise restoring the surfaces normally encountered in typical restroom cleaning operations. Moreover, substitution of other acids for those of the claimed combination has failed to provide liquid cleaners demonstrating acceptable performance. For example, substituting say citric acid for the oxalic acid or phosphoric acid or both acids, results in a slowdown of the cleaning action of the formulation. Substitution of other inorganic acids such as hydrochloric acid, nitric acid or sulfuric acid for the phosphoric acid component has been found to formulate compositions that are deleterious to many substrates and equipments on which the cleaner composition is to be used. Also, in the concentrations contemplated these latter acids tend to be excessively toxic and represent an occupational hazard to the user.

DETAILED DESCRIPTION OF THE INVENTION

Any suitable non-ionic surface active agent can be employed as the non-ionic surfactant component of the present invention. Particularly satisfactory non-ionic surface active agents are alkylaryl polyether alcohols available commercially as the "Igepals" or "Tritons". These compounds comprise alkylaryl polyether alcohols having the general formula $R—(O—CH_2—CH_2)_n—OH$ wherein R is an alkylaryl radical and n is an integer from about 1 to 30 or more and preferably about 1 to 20. The alkyl substituent or the aromatic nucleus may be octyl, nonyl, diamyl, n-dodecyl, isooctyl, etc. A typical "Igepal" product is nonyl phonoxypolyethoxyethanol having the structure:

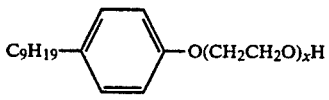

wherein x is 4 to 30.

Another commercially available non-ionic surfactant is a polyoxyalkylene derivative of hexitol anhydride partial long chain fatty acid ester invention is marketed as "Tween 85" a product of the Atlas Powder Company. Tween 85 is the reaction product of about 5 mols of ethylene oxide and one mol of sorbitan trioleate and is an oily liquid at 25° C. having a flash point of about 565° F., a fire point of about 645° F. and a specific gravity of about 1.00 to 1.05. Such reaction products containing from about 2 to 25 mols or more ethylene oxide per mol of the ester are especially preferred.

"Span 20" is also a commercially available non-ionic (Atlas Powder Company) and comprises essentially sorbitan monolaurate. Span 20 is an oily liquid having a flash point of about 400° F., a fire point of about 440° F. and a specific gravity of about 1.00 to 1.06. The long chain fatty acids which are employed in producing both the fatty acid partial esters of hexitol anhydrides and their polyalkylene derivatives contain about 12 to 24 carbon atoms per molecule. The acids can be saturated or unsaturate and include, for example, lauric, palmitic, stearic and oleic acids. By "hexitol anhydride" is meant inner esters having one cyclic oxygen per ring derived from hexahydric alcohol by intermolecular condensation and includes the mono-, anhydro- and dianhydro derivatives, i.e. hexides, hexitans, mannides, mannitans and the like. By "partial ester" is meant that the hydroxy groups of the anhydride are not all esterified; mono-, di- and tri-esters and mixtures thereof are preferred and these can be simple or mixed esters.

Non-ionic surface active fatty acid esters of the polyhydric alcohol are further examples of suitable non-ionic surface agents and can advantageously be a polyethylene glycol dilaurate having a molecular weight of about 400 although similar materials of higher or lower molecular weight can be used if desired, e.g. polyethylene glycol 400 mono-oleate. They can be prepared by treating the fatty acids with ethylene oxide or by esterifying the appropriate glycols. The fatty acid portion of the ester should normally be one having about 12 to 1 carbon atoms in its molecule, and generally the polyethylene glycol ester has a molecular weight of about 200 to 600.

Other non-ionic surface active agents contemplated for use in the invention are the alkali metal salts of long chain alkanols available commercially as the "Tergitols".

The cationic surface active component of the invention is a fluorinated alkyl quaternary ammonium halide such as the fluorinated alkyl quaternary ammonium iodide, bromide or chloride having alkyl groups of 4 to 16 carbon atoms. A particularly preferred cationic surfactant of the invention is "Fluorad FC-134" a fluorinated alkyl quaternary ammonium iodide manufactured by Minnesota Mining and Manufacturing Company.

The presence of the particular cationic surface active agent of the invention in combination with the non-ionic surface active agent has been surprising found to result in a formulation exhibiting a vastly reduced surface tension (dynes/cm). For example, at a level of 0.2% by weight which is optimal for an economical formulation with regard to performance standards in the industry, the cationic surface active agent delivers 2000 ppm when the cleaner composition is used as is, and over 30 ppm when diluted at a rate of 2-oz. concentrate per gallon of water. Other cationic surface active agents fail to provide such a reduction in surface tension.

The solvent component of the invention can be any of the alkylene glycol monoalkyl ethers having the structure:

$$HOCH_2CH_2OR$$

wherein R is lower alkyl. Illustrative of solvents suitable for use in the invention are the Cellosolves such as Butyl Cellosolve and Ethyl Cellosolve, trademarked products of Union Carbide.

The cleaning composition of the invention without a perfume or the like gives off a very strong objectionable odor that must be masked. The invention contemplates use of all masking agents capable of satisfactorily achieving this function. Examples of masking agents generally found successful are the mint and pine oil perfumes. A particularly preferred olfactory agent is a product comprising a mixture of wintergreen, pine oil, geranium crystals, a lactone fixative such as coumaric anhydride and turpentine. In addition to the foregoing ingredients, as is well known in the cleaner arts, there can be added to the compositions such additives as dyes, corrosion inhibitors and the like, which do not deleteriously detract from the invention.

Preparation of the composition is accomplished by simply mixing the ingredients together. The order of the mixing is not critical but most conveniently the acids are first dissolved in the water component followed by addition with stirring of the solvent component, surfactants and the olfactory agent.

The cleaner composition of the invention can be used per se, that is, as a concentrate. In many instances, however, it will be diluted with water, as required to form the desired operating cleaning solution. Generally, the extent of dilution in water will vary from about 3 to 50% by weight of the concentrate based on the total weight of the aqueous composition, depending principally on the application to which the cleaning solution is to be put.

In using the cleaning compositions of the invention, they may be applied in any convenient manner as, for instance, by the use of sponges, wash clothes, mops, brushes and the like.

Upon application, the cleaner composition of the invention is allowed to contact the cleaning surface for a period of time ranging from a few seconds to about 2 minutes depending upon whether the cleaner is used as a concentrate or a diluted aqueous solution and the degree of cleaning difficulty presented by the surface worked upon.

The following example is included to further illustrate the present invention.

EXAMPLE

A concentrate was formulated containing the following components in the amounts indicated:

| Components | Pounds |
|---|---|
| Water | 1830.0 lbs. |
| Phosphoric Acid 85% | 195.0 lbs. |
| Oxalic Acid | 67.5 lbs. |
| 2-Butoxy Ethanol | 200.0 lbs. |
| Non-Ionic Surfactant(1) | 120.0 lbs. |
| Cationic Surfactant(2) | 4.5 lbs. |

-continued

| Components | Pounds |
|---|---|
| Olefactory Agent[3] | 9.0 lbs. |

[1]nonylphenol polyethoxy ethanol
[2]fluorinated alkyl quaternary ammonium iodide
[3]a product of Carruba Inc. comprised of a mixture of wintergreen, pine oil, geranium crystals, coumaric anhydride (lactone fixative) and turpentine.

The order of addition was as listed and the mixing was conducted with agitation at slow speed with medium sheer. Warm water is optional, and will accelerate the dissolution of oxalic acid but will promote sudsing.

The composition was highly effective "as is" in the cleaning of commodes and urinals. When diluted to as little as 2 ounces by weight per gallon of water the resulting composition is effective for all other cleaning in the restroom such as porcelain sinks, stainless steel and chrome dispensers and restroom fixtures, floors and walls, metal stall partitions, metal and plastic waste receptacles, ceramic tile and grout, etc.

The foregoing example and description have been for the purpose of illustrating the invention and should not in any way be interpreted as limiting same. Many other modifications and ramifications will naturally suggest themselves to those skilled in the art based on this disclosure. These are intended to be comprehended as within the scope of this invention.

It is claimed:

1. A sanitary cleaning composition comprising
about 0.12 to 20% by weight phosphoric and,
about 0.04 to 9% by weight oxalic acid,
about 0.1 to 17% by weight of a non-ionic surfactant having the structure $R—(O—CH_2OCH_2)_n$ wherein R is an alkylaryl radical and n is an integer from about 1 to 20
about 0.03 to 0.3% by weight of a cationic surfactant comprising fluorinated alkyl quaternary ammonium iodide having an alkyl group of 4 to 16 carbon atoms
about 0.14 to 44% by weight of an alkylene glycol monoalkyl ether solvent having the structure $HOCH_2CH_2OR$ wherein R is lower alkyl, and
about 0.006 to 1.7% of an odor masking agent; and the balance water, and with the proviso that the phosphoric acid be present in an amount in excess of the oxalic acid.

2. A sanitary composition according to claim 1 wherein the non-ionic surfactant is nonylphenoxy polyethoxy ethanol.

3. A sanitary composition according to claim 1 wherein the solvent is 2-butoxy ethanol.

4. A sanitary composition according to claim 1 diluted with 3% to 50% by weight additional water.

5. A sanitary composition comprising:

| Components | Pounds |
|---|---|
| water | 1830.0 lbs. |
| phosphoric acid 85% | 195.0 lbs. |
| oxalic acid | 67.5 lbs. |
| 2-butoxy ethanol | 200.0 lbs. |
| nonyl phenoxy polyethoxy ethanol | 120.0 lbs. |
| fluorinated alkyl quaternary ammonium iodide | 4.5 lbs. |
| olfactory agent | 9.0 lbs. |

* * * * *